US006017421A

United States Patent [19]

Begemann

[11] Patent Number: 6,017,421

[45] Date of Patent: Jan. 25, 2000

[54] HEADBOX WITH BAFFLE

[75] Inventor: Ulrich Begemann, Heidenheim, Germany

[73] Assignee: Voith Sulzer Papiermaschinen GmbH, Germany

[21] Appl. No.: 09/110,913

[22] Filed: Jul. 6, 1998

[30] Foreign Application Priority Data

Jul. 4, 1997 [DE] Germany ..... 297 11 721

[51] Int. Cl.[7] ..... D21F 1/06

[52] U.S. Cl. ..... 162/336; 162/333; 162/344

[58] Field of Search ..... 162/216, 343, 162/336

[56] References Cited

U.S. PATENT DOCUMENTS

| | | | |
|---|---|---|---|
| 3,607,625 | 9/1971 | Hill | 162/343 |
| 3,840,430 | 10/1974 | Ely . | |
| 3,876,498 | 4/1975 | Justus . | |
| 3,923,593 | 12/1975 | Verseput . | |
| 3,939,037 | 2/1976 | Hill . | |
| 3,939,039 | 2/1976 | Seki et al. . | |
| 4,133,713 | 1/1979 | Chaung | 162/216 |
| 4,221,635 | 9/1980 | Kurtz et al. | 162/343 |
| 4,376,014 | 3/1983 | Bergstrom | 162/336 |
| 4,617,091 | 10/1986 | Rodal et al. | 162/343 |
| 4,765,868 | 8/1988 | Fujiwara . | |
| 4,812,209 | 3/1989 | Kinzler et al. . | |
| 5,560,807 | 10/1996 | Hauser | 162/183 |
| 5,603,807 | 2/1997 | Heinzmann . | |
| 5,622,603 | 4/1997 | Begeman et al. | 162/343 |
| 5,639,352 | 6/1997 | Ruf et al. | 162/216 |

FOREIGN PATENT DOCUMENTS

| | | |
|---|---|---|
| 2442925 | 4/1975 | Germany . |
| 2501365 | 7/1975 | Germany . |
| 2800547 | 6/1979 | Germany . |
| 3130406 | 4/1982 | Germany . |
| 2094364 | 9/1982 | United Kingdom . |

*Primary Examiner*—Peter Chin
*Assistant Examiner*—Kevin Cronin
*Attorney, Agent, or Firm*—Ostrolenk, Faber, Gerb & Soffen, LLP

[57] ABSTRACT

A headbox of a paper machine for distributing stock suspension over the machine width of the paper machine onto a forming or wire section includes a headbox nozzle that extends over the machine width and that has spaced apart top and bottom lips that gradually converge from the stock nozzle inlet toward the nozzle outlet. At least one baffle that extends over the machine width is located in the nozzle between the lips and spaced therefrom. The length of the baffle in the flow direction of the stock suspension is less than twice the maximum spacing or height between the top and bottom lips of the headbox nozzle, which is the spacing between them at the tallest space, typically at the upstream entrance end of the nozzle. In addition, the length of the baffle is at most less than 50% the length of the nozzle. The baffle tapers narrower in height in the flow direction, and the angle of divergence of the top and bottom surfaces of the baffle is less than 5° from the flow direction of the suspension through the nozzle.

10 Claims, 1 Drawing Sheet

HEADBOX WITH BAFFLE

BACKGROUND OF THE INVENTION

The present invention relates to a headbox of a paper machine or board machine and particularly to a baffle in the headbox.

A headbox having a baffle located in the headbox nozzle is disclosed, for example, in German Patent Application DE 36 07 306 A1 from the applicant. FIG. 1 of this application shows a two layer headbox with the stock feed in two layers, a turbulence generator which is connected downstream of a stock suspension distributor and a headbox nozzle which adjoins the turbulence generator downstream and a baffle in the nozzle, which separates the two stock suspension layers.

Furthermore, such a headbox is disclosed in U.S. Pat. No. 3,939,039, which shows a single layer headbox having a nozzle including a plurality of baffles, which have their attachment points directly after a perforated grating. This type of headbox has the disadvantage that the paper produced has a relatively hard formation and an unfavorable tearing length ratio.

SUMMARY OF THE INVENTION

It is an object of the present invention to provide a headbox which has a baffle located within it, which produces paper with an improved tearing length ratio and, at the same time, permits simplified maintenance of the headbox.

This object is achieved by headbox of a paper machine for distributing a stock suspension over the machine width of the paper machine and onto a forming section or wire section. The headbox includes a headbox nozzle that extends over the machine width and that has spaced apart top and bottom lips that gradually converge from the inlet toward the suspension outlet from the headbox nozzle. There is at least one baffle that extends over the machine width located in the headbox nozzle between the lips and spaced from the lips. The length of the baffle in the flow direction of the stock suspension is less than twice the maximum spacing or height between the top and bottom lips of the headbox nozzle, which is typically the spacing between the lips at the tallest space, at the upstream entrance end of the nozzle. In addition, the length of the baffle is at most less than 50% of the length of the headbox nozzle. The baffle also is not of uniform thickness, but rather is of tapering thickness in the flow direction. The angle of divergence of the top and bottom surfaces of the baffle is less than 5° from the flow direction of the suspension through the nozzle.

The inventor has discovered that the initial nozzle height has a significant influence on the quality of the headbox jet and, consequently, on the formation of the paper. As the initial nozzle height increases, the intensity of formation stripes increases, which impairs uniformity of the mass distribution of the suspension. For this reason, it is desirable to use baffles even in single layer headboxes. On the other hand, the flow guidance in the region of the transition from the turbulence generator to the baffle has particular importance. It is thus possible, for example, for abrupt steps or sharply divergent flow guidance systems to cause separations in the flow and to produce resultant vortices, which have an adverse effect as flow continues.

On the one hand, it is desirable to use baffles even in a single layer headbox to reduce the initial nozzle height of the headbox. Use of a plurality of baffles divides the total initial nozzle height into a plurality of small initial heights. On the other hand, a baffle that is too long produces an undesirable, hard web formation. The original alignment of the fibers in the paper is canceled out again by the excessive length of the baffle, and too low a tearing length ratio is produced.

Accordingly, the known headbox used for distributing stock suspension over the machine width on a paper machine wire or between two such wires has a headbox nozzle with convergent top and bottom lips over the machine width and, according to the invention, has at least one baffle of machine width in the headbox nozzle. That headbox is further developed so that the length of the baffle in the machine direction is less than twice the maximum spacing between the top and bottom lips of the headbox nozzle.

A known headbox designed to include a baffle is further developed so that the length of the baffle is at most less than 50%, and preferably 10–40%, of the length of the headbox nozzle. This configuration of the headbox in accordance with the invention has the advantage that the unnecessarily and undesirably large amount of fine turbulence which is produced by the surfaces of the baffle is reduced as a result of the shortened length of the baffle, and thus a more favorable tearing length ratio of the paper is produced. Furthermore, this shortened baffle avoids an excessively small amount of floc formation in the stock suspension, and hence avoids a hard web formation.

In a further advantageous embodiment of the headbox, the divergence angle of the baffle surfaces from the flow direction of the suspension through the nozzle, at least in the initial region of the baffle, is less than 5°. This means that the initial region of the baffle should not deflect the flow of suspension too sharply from its original direction, in order not to produce any separation phenomena.

It is also advantageous to design the baffle to be stationary, that is without a hinge. In conjunction with a short length baffle, this simplifies cleaning the headbox significantly, because during an operational stop, the baffle does not pivot downward and, as a result, simple cleaning between the baffles or between the baffle and the top or bottom lips is possible.

It is advantageous when the baffles are designed to be flexurally rigid in the machine direction.

Other features and advantages of the present invention will become apparent from the following description of the invention which refers to the accompanying drawing.

DETAILED DESCRIPTION OF THE INVENTION

Figure 1:
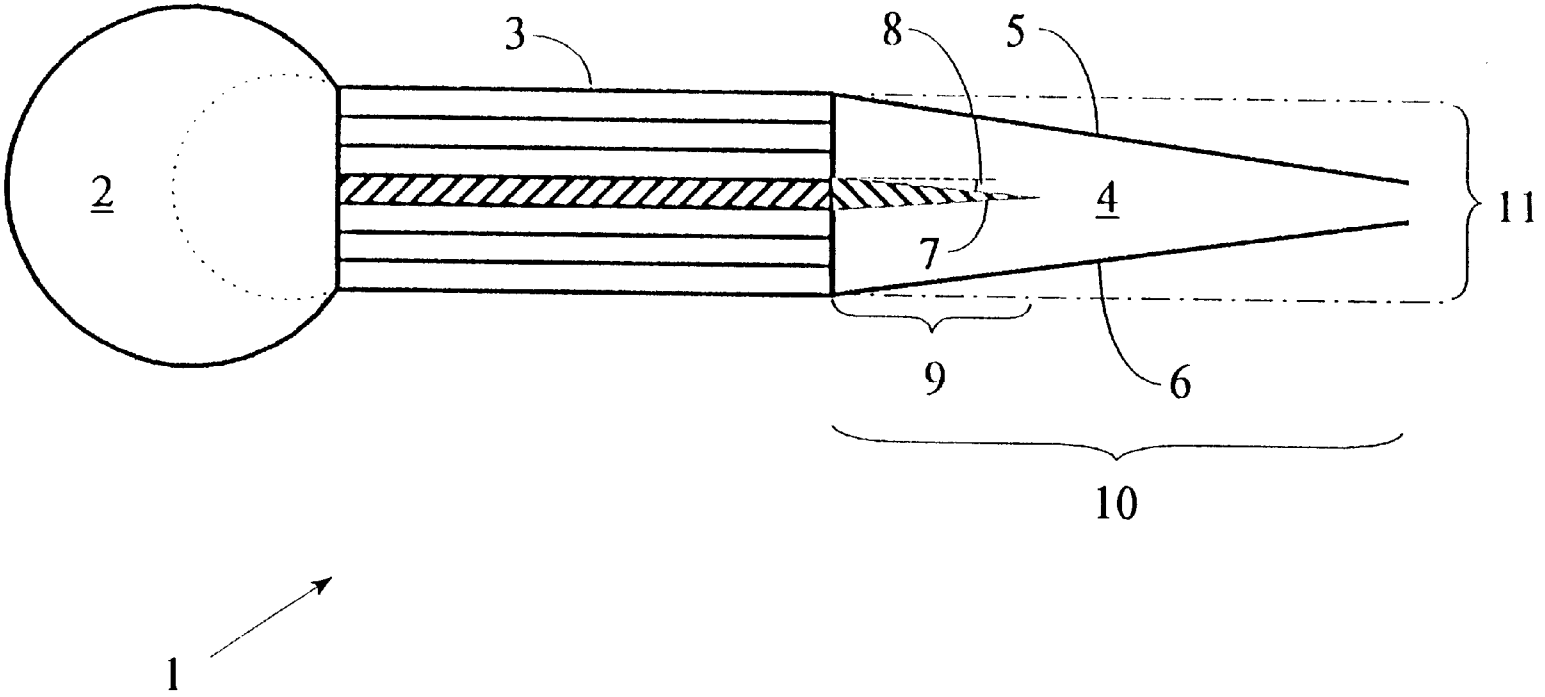
FIG. 1 shows an inventive single layer headbox with a baffle located inside it.

The headbox is of conventional construction, except for the later described baffle. The headbox includes a known transverse stock suspension distributor 2. An adjoining turbulence generating region 3 located downstream receives stock from the distribution 2. The region 3 merges into the headbox nozzle 4 located further downstream. The nozzle has a top lip 5 and a bottom lip 6, which converge toward the nozzle outlet.

A baffle 7 in the headbox nozzle 4 is fastened in a stationary and flexurally rigid manner at the exit from the turbulence generating region 3. The length 9 of the baffle in the stock flow direction through the nozzle is less than twice the maximum height of the headbox nozzle 4. In the illustrated case, this height corresponds to the nozzle entry height 11.

The divergence angle 8 at the start or upstream end of the baffle 7, between both opposite surfaces of the baffle 7 and the direction in which the suspension flows out of the turbulence generating region 3, is less than 5°.

The length of the baffle 9 should be at most 50% of the nozzle length 10, with a length of between 10 and 40% of the nozzle length being viewed as advantageous and with a length of about 30% of the nozzle length being viewed as particularly advantageous.

The outlet from the headbox distributes the pulp suspension that has passed through the nozzle over the machine width in a conventional forming section, e.g., in a nip between two forming section wires or on a single wire of that section.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A headbox for distributing a stock suspension over the machine width of a paper machine or the like, the headbox comprising:

a distributor for supplying stock suspension to the headbox;

a headbox nozzle communicating with the distributor, the nozzle having an upstream end for receiving the stock suspension and an outlet for dispensing the stock suspension therethrough over the machine width of the headbox, the nozzle having a top lip and a bottom lip which are spaced apart and include a position of maximum spacing between the top and bottom lips along a flow direction of the suspension through the nozzle, the lips converging toward each other in the flow direction of the stock suspension away from the position of maximum spacing through the nozzle toward the nozzle outlet, and the lips extending over the machine width of the headbox; and at least one baffle being fastened at the upstream end of the headbox in a stationary and flexurally rigid manner and extending in the flow direction from the position of maximum spacing of the lips toward the outlet without extending beyond the headbox outlet, the baffle also extending through the headbox nozzle and over the machine width, the baffle being shorter in height than the spacing distance between the top and bottom lips at the headbox outlet and the baffle having a length in the flow direction of the suspension through the nozzle which is less than twice the maximum spacing between the top and bottom lips of the headbox nozzle.

2. The headbox of claim 1, wherein the baffle extends from the upstream end of the nozzle in a direction toward the nozzle outlet.

3. The headbox of claim 2, wherein the length of the baffle in the flow direction of the stock suspension is at most less than 50% of the length of the headbox nozzle in the flow direction.

4. The headbox of claim 2, wherein the length of the baffle in the flow direction of the stock suspension is in the range of 10%–40% of the length of the headbox nozzle in the flow direction.

5. The headbox of claim 2, wherein the length of the baffle in the flow direction of the stock suspension is about 30% of the length of the headbox nozzle in the flow direction.

6. The headbox of claim 3, wherein the baffle tapers in height between the top and bottom lips in the flow direction.

7. The headbox of claim 6, wherein the baffle has an initial region toward the upstream end of the nozzle, the baffle has top and bottom sides and is so shaped that in its initial region, the shape of the baffle diverges from the flow direction of suspension through the nozzle at a divergence angle that is less than 5°.

8. The headbox of claim 3, wherein the baffle has an initial region toward the upstream end of the nozzle, the baffle has top and bottom sides and is so shaped that in its initial region, the shape of the baffle diverges from the flow direction of suspension through the nozzle at a divergence angle that is less than 5°.

9. The headbox of claim 2, wherein the baffle is flexurally rigid in the flow direction.

10. The headbox of claim 2, further comprising a turbulence generating region in the headbox between the distributor and the upstream end of the nozzle.

* * * * *